United States Patent [19]

Soumiya

[11] Patent Number: 4,538,901

[45] Date of Patent: Sep. 3, 1985

[54] ELECTROPHOTOGRAPHIC COPIER WITH A PHANTOM IMAGE SUPPRESSION FUNCTION

[75] Inventor: Norimasa Soumiya, Soka, Japan

[73] Assignee: Ricoh Company, Ltd., Japan

[21] Appl. No.: 572,294

[22] Filed: Jan. 19, 1984

[30] Foreign Application Priority Data

Jan. 20, 1983 [JP] Japan ..... 58-7748
May 20, 1983 [JP] Japan ..... 58-88724

[51] Int. Cl.[3] ..... G03G 21/00

[52] U.S. Cl. ..... 355/14 E; 355/14 R; 355/15; 355/77; 430/31

[58] Field of Search ..... 355/14 E, 14 R, 3 R, 355/15, 77; 430/31

[56] References Cited

U.S. PATENT DOCUMENTS 4,413,899 11/1983 Karasawa et al. ..... 355/14 R
4,448,512 5/1984 Bean ..... 355/15 X
4,474,455 10/1984 Hirakura et al. ..... 355/14 R

*Primary Examiner*—R. L. Moses
*Attorney, Agent, or Firm*—Guy W. Shoup

[57] ABSTRACT

An electrophotographic copying machine capable of suppressing the formation of phantom images with a simple structure is provided. The machine includes a pre-transfer exposure lamp for irradiating a toner image formed on an imaging surface and a post-transfer exposure lamp for irradiating the imaging surface after separation of a transfer medium, to which the toner image has been transferred, from the imaging surface. The pre-transfer exposure lamp is provided to ease the transfer of toner image to the transfer medium and the post-transfer exposure lamp is provided to remove residual charge from the imaging surface thereby preparing the imaging surface ready to be used for the next cycle of copy operation. In the present invention, a ratio of light amount of the post-transfer exposure to the light amount of the pre-transfer exposure is maintained within a predetermined range, preferably 30–60%.

15 Claims, 3 Drawing Figures

ELECTROPHOTOGRAPHIC COPIER WITH A PHANTOM IMAGE SUPPRESSION FUNCTION

BACKGROUND OF THE INVENTION

1. Field of the Invention

This invention generally relates to imaging technology, and, in particular, to transfer-type electrophtographic copying machines having a phantom image suppression function. More specifically, the present invention is concerned with electrophotographic imaging machines including a blanket exposure device for carrying out a blanket exposure prior to the transfer of a toner image formed on an imaging surface to a recording medium and a discharging device for discharging the remaining charge on the imaging surface after the image transfer.

2. Description of the Prior Art

Electrophotographic technology is well known in the art and a typical electrophotographic copying machine of the image transfer type includes a photosensitive drum comprised of a photosensitive member attached to the peripheral surface of a rotatably supported drum with the outer peripheral surface of the photosensitive member defined as an imaging surface, a charger for uniformly charging the imaging surface, an image exposure device for exposing the thus uniformly charged imaging surface to an original image thereby having the charge on the imaging surface selectively dissipated to form an electrostatic latent image, a developing device for developing the latent image thereby converting the latent image into a visible toner image, a blanket exposure device for applying uniform light to the toner image on the imaging surface, an image transfer device for transferring the toner image to a transfer medium from the imaging surface, and a discharging device for removing residual charge on the imaging surface after the image transfer by the application of uniform light to the imaging surface.

As described above, the blanket exposure device is provided so as to make the difference in potential between the imaging surface and the toner image to be as small as possible thereby allowing to enhance the transfer characteristic of the toner image to the transfer medium from the imaging surface and the separation characteristic of the separation of the transfer medium from the imaging surface. On the other hand, the discharging device, normally comprised of a lamp, for removing residual charge from the imaging surface is provided to prepare the imaging surface ready for the following sequence of copying cycle. Particularly, when A.C. discharging is employed in the separating device for separating the transfer medium from the imaging surface, the blanket exposure device is provided so as to attain desired characteristics for the image transfer and the separation of transfer paper.

This blanket exposure prior to image transfer has its object to have the charge in the imaging surface at the position below the toner image removed, so that the amount of light required for this blanket exposure tends to be larger necessarily. For example, if desired to maintain only the characteristics of image transfer and separation of transfer medium, the amount of light of blanket exposure prior to image transfer approximately ranges between two to seven times of that required in image exposure. However, the fatigue characteristic of photosensitive member comes to be important when such a large amount of light is used. That is, a phantom image may be produced due to differences in fatigue levels between the image and non-image portions on the imaging surface. On the other hand, since the discharging lamp is to simply remove residual charge from the imaging surface after image transfer, the required amount of light is not so large and it may be less than the amount of light required in image exposure.

Customarily, the light amounts for the pre-transfer and post-transfer blanket exposures have been determined separately and thus there has been a chance of producing a phantom image due to differences in light amount between these two blanket exposures. Depending upon which of the light amounts is exceedingly larger than the other, a negative or positive phantom image may be produced.

SUMMARY OF THE INVENTION

It is therefore a primary object of the present invention to provide an improved imaging technology capable of preventing a phantom image from being produced at all times.

Another object of the present invention is to provide an image-transfer type electrophotographic copying machine which is so structured to maintain a ratio of light amount between pre-transfer blanket exposure and post-transfer blanket exposure within a predetermined range thereby allowing to produce a copy image of excellent quality without phantom images.

A further object of the present invention is to provide an image-transfer type electrophotographic copying machine simple in structure and thus easy to manufacture and yet capable of preventing any phantom image from being produced.

A still further object of the present invention is to provide an image-transfer type electrophotographic imaging system in which pre-transfer and post-transfer blanket exposures are carried out in a predetermined relation.

Other objects, advantages and novel features of the present invention will become apparent from the following detailed description of the invention when considered in conjunction with the accompanying drawings.

DESCRIPTION OF THE PREFERRED EMBODIMENTS

In accordance with the present invention, pre-transfer and post-transfer exposures are carried out such that a predetermined relation holds between the amounts of light used in these exposures. Regarding the terminology used in the present specification, it is to be noted that "pre-transfer exposure" signifies the application of a blanket or uniform exposure of light to a toner image formed on an imaging surface, such as a photosensitive member, prior to transfer of the toner image to a transfer medium, and "post-transfer exposure" signifies the application of a blanket or uniform exposure of light to the imaging surface after transfer of the toner image to the transfer medium.

Now, the present invention will be described in detail with reference to the drawings by way of embodiments below.

Figure 1:
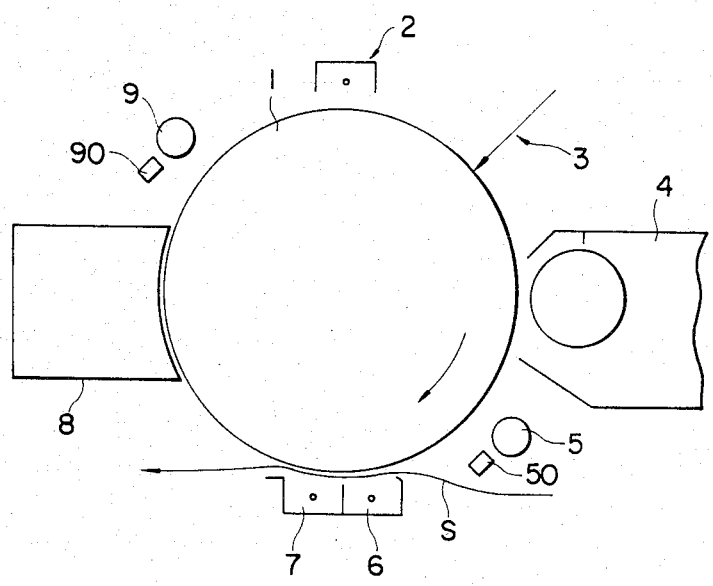
FIG. 1 is a schematic illustration showing the overall structure of an electrophotographic copying machine of the image-transfer type to which the present invention is advantageously applied.

FIG. 1 schematically shows an image-transfer type electrophotographic copying machine to which the present invention is adavantageously applied. As shown, the copying machine includes a photosensitive drum 1 which is rotatably supported and driven to rotate in the direction indicated by the arrow at constant speed. The photosensitive drum includes a rotatably supported drum and a photosensitive member fixedly attached to the periphery of the drum, and the outer peripheral surface of the photosensitive member is defined as an imaging surface on which an electrostatic latent image is first formed and then converted into a visible toner image by development. Around the periphery of the photosensitive drum 1 is disposed various devices for carrying out an electrophotographic imaging process which is well known for one skilled in the art.

That is, as shown disposed above the drum 1 in FIG. 1 is a corona charging device 2 for charging the imaging surface to a predetermined polarity uniformly, and downstream of the charging device 2 with respect to the direction of rotation of the drum 1 is disposed an image exposure device 3 ( indicated only by a beam of light image ) for exposing the thus charged imaging surface to an original image to be reproduced thereby causing the charge to be selectively dissipated to form an electrostatic latent image on the imaging surface in accordance with the light pattern of original image. Downstream of the image exposure device 3 is disposed a developing device 4 for developing the electrostatic latent image by applying toner thereto thereby converting the latent image into a visible toner image. There is disposed a pre-transfer exposure lamp 5 downstream of the developing device 4 and thus light is uniformly applied to the toner image formed on the imaging surface before transfer of the toner image to a transfer medium. A corona transfer device 6 is provided downstream of the pre-transfer exposure lamp 5 for having the toner image transferred to transfer paper S. Provided adjacent to the transfer device 6 is a corona separating device 7 for separating the transfer paper S from the imaging surface after transfer of toner image to the transfer paper S. Moreover, a cleaning device 8 is provided to clean the imaging surface by removing the residual toner therefrom. Also provided is a discharging lamp ( post-transfer exposure lamp ) 9 for removing the remaining charge on the imaging surface after removal of the residual toner therefrom. Since the operation of the above-described structure is well known to one skilled in the art, its detailed description will be omitted here.

Figure 2:
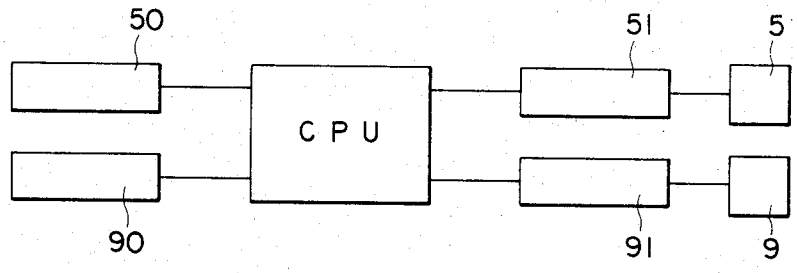
FIG. 2 is a block diagram showing the light amount control circuit which is constructed in accordance with one embodiment of the present invention and which may be applied to the copying machine of FIG. 1.

In accordance with one embodiment of the present invention, also provided in the vicinity of the pre-transfer exposure lamp 5 is a light-receiving element 50 for detecting the amount of light irradiated by the lamp 5. Furthermore, in the vicinity of the discharging or post-transfer exposure lamp 9 is disposed another light-receiving element 90 for detecting the amount of light irradiated by the lamp 9. These light-receiving elements 50 and 90 are connected to a central processing unit ( CPU ), as shown in FIG. 2, which also controls the overall operation of the copying machine shown in FIG. 1. The CPU is also connected to supply control signals to pre-transfer and post-transfer lamp driving circuits 51 and 91 which, in turn, are connected to drive the pre-transfer and post-transfer lamps 5 and 9, respectively.

Experiments have been conducted by providing the light amount control circuit of FIG. 2 into a plain paper copier FT4060, manufactured by Ricoh Co., Ltd. and having the overall structure shown in FIG. 1, using a fluorescent lamp irradiating light having the wavelength of 525 nm as pre-transfer and post-transfer lamps 5 and 9. In the experiments, an electrophotographic copying process well known to one skilled in the art has been carried out under different conditions and the conditions of formation of phantom images were investigated. It is to be noted that, for the sake of brevity, the amount of light irradiated by the pre-transfer exposure lamp 9 will be indicated by "PTL" and the amount of light irradiated by the discharging or post-transfer exposure lamp 5 will be indicated by "QL."

EXPERIMENT I

Photosensitive drum used: Se-As family
Set value of PTL: 5 micro-J/cm$^2$
Set value of QL: 1 micro-J/cm$^2$ This is the case where PTL and QL were set separately without consideration of particular relation in light amount between the pre-transfer and post-transfer exposures and the ratio QL/PTL in this case is 20%. The presence of a positive phantom image was observed in the half-tone area of reproduced image.

EXPERIMENT II

Under the conditions of Experiment I, PTL and QL were both set at 3 micro-J/cm$^2$. In this case, the ratio QL/PTL is 100% and the formation of negative phantom image was observed.

EXPERIMENT III

Photosensitive drum used: Se-As family
Set value of PTL: 5 micro-J/cm$^2$
Set value of QL: 2.5 micro-J/cm$^2$ While maintaining the ratio QL/PTL at 50%, the process was carried out to see whether phantom images were produced. The production of negative and positive phantom images has been found to be very small and they could be appreciated only when carefully examined.

EXPERIMENT IV

While maintaining the ratio QL/PTL at 50%, each of PTL and QL was set at a larger value as shown.

Set value of PTL: 10 micro-J/cm$^2$
Set value of QL: 5 micro-J/cm$^2$

The formation of phantom images was virtually not appreciable and thus the results were similar to those of Experiment III.

EXPERIMENT V

Based on the results obtained in Experiments III and IV, the formation of negative and positive phantom images was examined by varying the ratio of QL/PTL, and it has been found that an allowable range of values of QL/PTL, in which the formation of negative and positive phantom images may be disregarded, is 30–60%.

EXPERIMENT VI

The lamps 5 and 9 become gradually stained, for example, due to deposition of floating toner or the like, and the degree of stain as a function of time differs depending on a particular location at which each of these lamps 5 and 9 is disposed. Particularly with respect to the pre-transfer lamp 5, the degree of stain due to deposition of floating toner is higher than that for the post-transfer lamp 9. Thus, it may be difficult to maintain the ratio of QL/PTL in the allowable range of 30–60% as obtained in the above-described Experiment V just by initially setting the amount of light irradiated by each of these lamps to be in this range. Therefore, in accordance with the above-described preferred embodiment of the present invention, the amount of light irradiated by each of the lamps 5 and 9 is constantly monitored and controlled such that the ratio of QL/PTL stays within the allowable range 30–60%. This test was conducted under the following conditions Photosensitive drum used: Se-As family CPU: Programmed to control the amount of light irradiated by each of lamps 5 and 9 such that the ratio of QL/PTL is maintained at 40–60%.

After carrying out the copy cycle approximately 40,000 times, the pre-transfer lamp 5 was examined and found that it was significantly stained by toner; however, the production of phantom images was extremely small.

Figure 3:
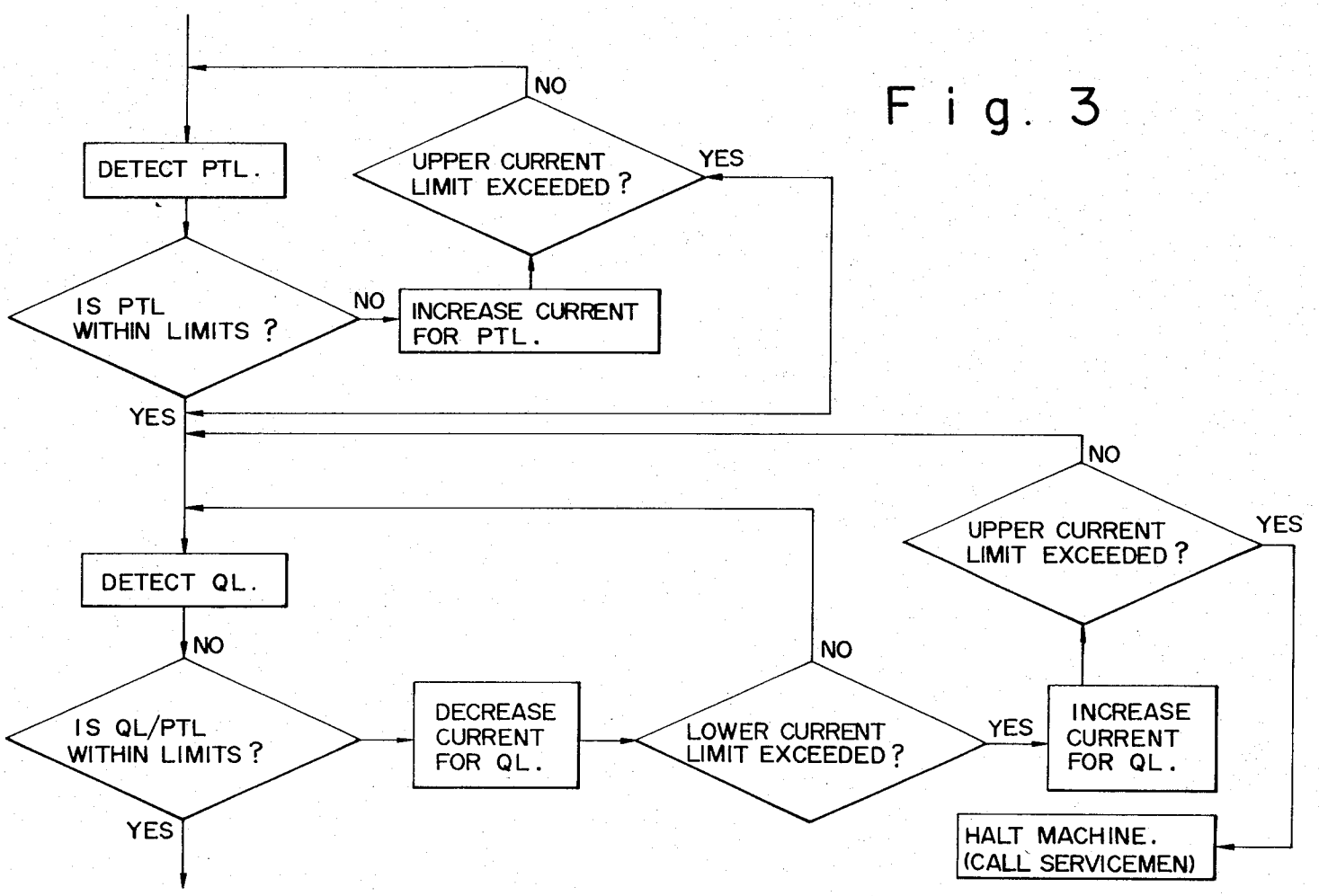
FIG. 3 is a flow chart illustrating the operation of the control circuit shown in FIG. 2.

Now, the operation of the light amount control circuit shown in FIG. 2 embodying the present invention will be described in detail with reference to the flow chart shown in FIG. 3. When the light-receiving element 50 receives the light irradiated by the pre-transfer lamp 5, PTL is detected and it is tested as to whether this is within predetermined limits by CPU. If not, CPU supplies a signal to the driver 51 to increase a driving or PTL current. The thus increased PTL is again detected by the element 50 and its value is checked whether it is within limits. If affirmative, the flow proceeds to the next step. On the other hand, even if PTL is judged to be outside limits, if PTL has been increased to its predetermined maximum value, the sequence proceeds to the next step. Then, upon detection of the amount QL of light irradiated by the post-transfer lamp 9 by the other light-receiving element 90, CPU calculates the ratio of QL/PTL and examines as to whether the calculated ratio falls within the predetermined range, e.g., 40–60%. If negative, then CPU supplies a control signal to the driver 91 to lower QL current and then with the thus lowered QL, the ratio of QL/PTL is again examined. This process is repeated until QL/PTL comes to be within limits or the value of QL reaches a predetermined lower limit. If the value of QL has reached its lower limit, then the value of QL is gradually increased stepwise to test as to whether QL/PTL may be set within limits until QL/PTL is in fact brought into the predetermined range or the value of QL reaches its predetermined upper limit. If the value of QL has reached its upper limit in this sequence of operation, the operation of machine is halted with or without giving a warning signal to that effect.

EXPERIMENT VII

Photosensitive drum used: Se-Te-Cl family

Set value of PTL: 2 micro-J/cm$^2$

Set value of QL: 1 micro-J/cm$^2$

In this experiment, a tungsten lamp was used for both of pre-transfer and post-transfer exposure lamps 5 and 9. In this case, it has also been found that no appreciable phantom images are produced when the ratio of QL/PTL is maintained in the above-mentioned range.

As described above, it can be understood that there is present a particular relation between QL and PTL as to the production of appreciable phantom images. In other words, when PTL is increased exceedingly as compared with QL, a positive phantom image may be obtained as in Experiment I; whereas, when QL is increased exceedingly as compared with PTL, there is obtained a negative phantom image as in Experiment II. On the other hand, by maintaining the ratio between QL and PTL in a predetermined range, it has been found that the production of appreciable phantom images may be suppressed effectively. For example, if the value of PTL is to be determined in order to obtain optimized or preferred image-transfer and transfer paper separating characteristics, then the value of QL should be determined accordingly such that the ratio between PTL and QL falls within a predetermined range, whereby no appreciable phantom images are well prevented from being produced.

It is to be noted that the value of QL in accordance with the present invention must be relatively larger as compared with the customarily used values for QL. Therefore, the present invention could not have been made easily even if the values of QL have been variously set in the prior art because the prior art idea of setting the value of QL has been primarily focused on removal of the remaining charge on the imaging surface.

As described before, in reality, the ratio between PTL and QL constantly varies as a function of time because the lamps 5 and 9 become stained, for example due to deposition of toner, in different manners. Thus, in accordance with the preferred embodiment of the present invention, the amount of light irradiated from each of the lamps 5 and 9 is constantly monitored and the driving power of each of the lamps 5 and 9 is suitably controlled to maintain the ratio between PTL and QL to stay within predetermined limits. In one method which is advantageously applied to the case where the lamps 5 and 9 are not so much stained, the amount of light irradiated from each of the lamps 5 and 9 is set initially at a predetermined level to satisfy a particular relation and these levels are maintained during operation; on the other hand, in another method which is particularly suited to the case where at least one of the lamps 5 and 9 are stained significantly and differently, the amount of light irradiated from one or both of the lamps 5 and 9 is controlled to maintain the ratio between PTL and QL within predetermined limits. As a further method, a combination of the previously described two methods may also be used advantageously.

In accordance with another aspect of the present invention, there is provided an embodiment which is characterized by using the same kind of light source as light sources for pre-transfer and post-transfer exposure lamps 5 and 9. Such a light source may be any of the conventionally used light source which is suitable for a particular photosensitive member used, and it may be comprised, for example, of fluorescent lamp, halogen lamp, cold-cathode tube, L.E.D., or the like. Moreover, these pre-transfer and post-transfer light sources 5 and 9 are preferably connected to receive power from the same power source. With such a structure, in accordance with this embodiment of the present invention, the ratio between the amount of light from the pre-transfer light source 5 and the amount of light from the post-transfer light source 9 is controlled to stay within predetermined limits as described with respect to the previous embodiment. In this case, such a control may be carried out in various manners. For example, in one form, such a control of light amount ratio may be carried out by adjusting the width of a slit which is located between the photosensitive drum 1 and the corresponding light source and through which the light from the light source 5 or 9 is passed. Alternatively, such a control may also be carried out by changing the distance between the drum 1 and the corresponding light source. As a further alternative, a variable resistor may be interposed between the common power source and each of the light sources 5 and 9 and the variable resistors may be suitably adjusted to change the level of driving current supplied to each of the light sources 5 and 9.

Experiments have been conducted using a fluorescent lamp having a peak of spectral irradiation intensity at 525 nm as the pre-transfer and post-transfer exposure lamps 5 and 9 connected to receive power from the common power supply with the provision of a variable resistor between the common power supply and each of the lamps 5 and 9.

First, the light amount PTL from the pre-transfer lamp 5 was set at 5 micro-J/cm$^2$ and the light amount QL from the post-transfer lamp 9 was set at 1 micro-J/cm$^2$ ( QL/PTL=20% ). When the copy cycle was carried out under the condition, there was produced a positive phantom image in the resulting copy image. Then, when the copy cycle was carried out after changing the setting to PTL=QL=3 micro-J/cm$^2$ (QL/PTL=100%), a negative phantom image was produced in the resulting copy image.

Then, when the copy cycle was carried out under the setting of PTL=5 micro-J/cm$^2$ and QL=2.5 micro-J/cm$^2$ (QL/PTL=50% ), the production of phantom images was suppressed effectively to the extent that they were barely appreciable by naked eyes. Then, while maintaining QL/PTL=50%, the setting was changed by increasing the light amounts to PTL=10 micro-J/cm$^2$ and QL=5 micro-J/cm$^2$. Under the condition, the copy cycle was carried out and the effective suppression of phantom images was confirmed. Moreover, the copy cycle was repetitively carried out by varying the value of QL for each value of PTL and an allowable range of QL/PTL in which phantom images are produced only barely noticeably has been found to be 30–60%. Then, with the setting of PTL=5 micro-J/cm$^2$ and QL=2.5 micro-J/cm$^2$, the copy cycle was repetitively carried out over 120,000 times consecutively and no appreciable phantom images were found. The ratio of QL/PTL was maintained substantially at constant during the continuous copying operation of 120,000 copies. Incidentally, the lamps 5 and 9 were cleaned once after making 60,000 copies.

Then, the similar experiments were conducted using a cold-cathode tube instead of fluorescent lamp as the pre-transfer and post-transfer light sources 5 and 9 and the identical results were obtained. In this case, the light amount control was carried out by adjusting the width of a slit in front of each of the light sources.

As described above, in accordance with this embodiment of the present invention, the formation of phantom images may be effectively suppressed by using the same kind of light source for the pre-transfer and post-transfer light sources and a common power source for supplying power to each of the light sources and controlling the ratio of light amounts from both of the light sources to stay within predetermined limits, if necessary.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. An electrophotographic copying machine capable of suppressing the formation of phantom images, comprising:

a photosensitive member having an imaging surface;

image forming means for forming an electrostatic latent image of an original image on said imaging surface;

developing means for developing said latent image thereby converting said latent image into a visible toner image;

first irradiating means for irradiating said toner image on said imaging surface with light having a first light amount;

transfer means for transferring said toner image thus irradiated by said first irradiating means to a transfer medium from said imaging surface;

second irradiating means for irradiating said imaging surface with light having a second light amount; and control means for controlling a light amount ratio between said first and second light amounts to stay within a predetermined range.

2. The machine of claim 1 wherein said light amount ratio is defined as a ratio of second light amount to first light amount and said ratio is maintained within a range between 30% and 60%.

3. The machine of claim 2 wherein said control means includes a first light-receiving element disposed to receive light irradiated from said first irradiating means, a second light-receiving element disposed to receive light irradiated from said second irradiating means and a CPU connected to receive signals from said first and second light-receiving elements thereby controlling at least one of said first and second irradiating means to maintain said light amount ratio to be in said range.

4. The machine of claim 1 wherein said first and second irradiating means are comprised of the same kind of light source.

5. The machine of claim 4 wherein said light source is selected from a group consisting of a fluorescent lamp, halogen lamp, light emitting diode and cold-cathode tube.

6. The machine of claim 4 further comprising a common power supply connected to supply a driving power to each of said first and second irradiating means.

7. The machine of claim 2 wherein said photosensitive member includes a Se-As material.

8. The machine of claim 2 wherein said photosensitive member includes a Se-Te-Cl material.

9. The machine of claim 1 wherein said photosensitive member is fixedly attached to the periphery of a drum which is rotatably supported and driven to rotate at constant speed.

10. The machine of claim 9 wherein said image forming means includes a charging device for charging said imaging surface uniformly to a predetermined polarity and an image exposure device for applying a light image of original to the thus uniformly charged imaging surface.

11. An electrophotographic copying process, comprising:

a step of forming a toner image of an original image on an imaging surface;

a step of irradiating said toner image with light having a first light amount;

a step of transferring said toner image thus irradiated by the light having a first light amount to a transfer medium; and a step of irradiating said imaging surface with light having a second light amount, characterized by controlling a light amount ratio of said second light amount to said first light amount to stay within a predetermined range.

12. The process of claim 11 wherein said range is between 30 and 60%.

13. The process of claim 12 wherein said step of forming a toner image includes uniformly charging said imaging surface, applying a light image of original to said thus uniformly charged imaging surface thereby selectively dissipating the uniform charge to form an electrostatic latent image and developing said latent image thereby converting said latent image into said toner image which is visible to human eyes.

14. The process of claim 13 further comprising a step of separating said transfer medium from said imaging surface after transfer of said image to said transfer medium.

15. The process of claim 14 further comprising a step of removing residual toner from said imaging surface after separation of said transfer medium from said imaging surface.

* * * * *